US007028518B2

(12) United States Patent
Sasaki et al.

(10) Patent No.: US 7,028,518 B2
(45) Date of Patent: Apr. 18, 2006

(54) METHOD OF PRODUCING SEAMLESS STEEL TUBES

(75) Inventors: Kenichi Sasaki, Wakayama (JP); Akihito Yamane, Amagasaki (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 193 days.

(21) Appl. No.: 10/670,193

(22) Filed: Sep. 26, 2003

(65) Prior Publication Data

US 2004/0065133 A1 Apr. 8, 2004

Related U.S. Application Data

(63) Continuation of application No. PCT/JP03/00751, filed on Jan. 27, 2003.

(30) Foreign Application Priority Data

Jan. 28, 2002 (JP) ..... 2002-018622

(51) Int. Cl.
*B21B 17/04* (2006.01)
*B21B 37/02* (2006.01)

(52) U.S. Cl. ..... 72/9.2; 72/11.8; 72/235

(58) Field of Classification Search ..... 72/8.9, 72/9.2, 9.3, 9.4, 11.6, 11.8, 208, 209, 235, 72/248

See application file for complete search history.

(56) References Cited

U.S. PATENT DOCUMENTS 1,858,990 A * 5/1932 Foren ..... 72/208
3,587,263 A * 6/1971 McCarthy ..... 72/9.3
4,819,507 A * 4/1989 Pescher ..... 74/665 GA

FOREIGN PATENT DOCUMENTS

| | | |
|---|---|---|
| JP | 57-17318 | 1/1982 |
| JP | 61-007010 | 1/1986 |
| JP | 61-74719 | 4/1986 |
| JP | 61-86020 | 5/1986 |
| JP | 63-230214 | 9/1988 |
| JP | H05-75485 | 10/1993 |
| JP | 08-071616 | 3/1996 |
| JP | 10-005817 | 1/1998 |

* cited by examiner

*Primary Examiner*—Lowell A. Larson
(74) *Attorney, Agent, or Firm*—Clark & Brody

(57) ABSTRACT

A method of producing a seamless steel tube to enable it to suppress not only the deviations in wall thickness occurring in the direction of reduction in a mandrel mill but also the derivations in thickness occurring at places deviating from the direction of reduction:

measuring the wall thicknesses within the circumferential directions of a seamless steel tube 14 rolled in a production line comprising a mandrel mill 11 consisting of a plurality of reduction stands $\mathbf{11}_1$ to $\mathbf{11}_5$ having reduction rolls disposed in succession with the directions of reduction varied each other, and controlling, separately and individually based on the results of the measurement, the positions of both ends of each axis of the reduction rolls $\mathbf{11}_4$, $\mathbf{11}_5$ in the final reduction stands of the mandrel mill 11 so that the deviations in wall thickness can be minimized.

1 Claim, 8 Drawing Sheets

METHOD OF PRODUCING SEAMLESS STEEL TUBES

This application is a continuation of International Patent Application No. PCT/JP03/00751, filed Jan. 27, 2003. This PCT application was not in English as published under PCT Article 21(2).

TECHNICAL FIELD

This invention relates to a method of producing seamless steel tubes using a mandrel mill by which the deviations or irregularities of wall thickness within circumferential directions (hereinafter referred to as "deviations in thickness") can be reduced.

PRIOR ART

In the manufacture of seamless tubes, it is demanded that the deviations in thickness be reduced as far as possible so that (1) the ratio of accepted products in wall thickness inspection may be increased, (2) the yield of thin-walled products within the specified tolerance range may be improved and (3) the sale of such products may be promoted by coping with the manufacture of such products within narrower dimensional tolerance ranges. For example, Japanese Patent Examined Publication No. H05-75485 proposes a method of manufacturing seamless steel tubes using a 2-roll stand mandrel mill as a method to achieve the object described above.

The method proposed in the above-cited Japanese Patent Examined Publication No. H05-75485 consists in that since, in a mandrel mill in which the directions of reduction of two neighboring 2-roll stands cross with each other at an angle of 90° and the final stands does not reduce tubes but the upper 2 to 4 stands from the final ones finish reduction, deviations in thickness occur in the directions to the groove bottoms and in the directions making an angle of 45° with the groove bottoms, as shown in FIG. 6, the work sides and drive sides of the 2 to 4 finishing stands in the mandrel mill should be operated at different rolling gap so that the differences in wall thickness within the circumferential directions may be minimized geometrically.

The reason why such deviations in thickness occur in the directions to the groove bottoms and in the directions making an angle of 45° with the groove bottoms in a mandrel mill in which the directions of reduction of two neighboring 2-roll stands cross at 90°, as shown in FIG. 6 is as follows.

In carrying out the rolling in a mandrel mill in which the directions of reduction of two neighboring 2-roll stands cross at 90°, it is ideal that when the groove bottom radius in a reduction roll 1 in a 2-roll stand is represented by R1, the outside diameter of a mandrel bar 2 by Db, the intended finish wall thickness of a steel tube 3 under rolling by ts, and the groove bottom-to-groove bottom distance in the reduction rolls 1 by G, as shown in FIG. 7(*a*), the groove bottom-to-groove bottom distance G be given by the expression G=2R1 and the intended finish wall thickness ts by the expression ts=(G−Db)/2. Then, there are no geometrical deviations in thickness.

However, the number of mandrel bars 2 which a plant can keep is limited and, in practice, several kinds of steel tubes 3 differing in wall thickness are produced using the same mandrel bar 2 having a certain outside diameter. For example, when a tube is rolled using a mandrel bar 2 having an outside diameter differing from the ideal outside diameter and each end of the reduction rolls is closed in the same amount so that the groove bottom-to-groove bottom distance in the reduction rolls 1 may become equal to Ga, as shown in FIG. 7(*b*), since the center of the radius R1 shifts from the pass center and the R1 increases in the offset R1-Ga/2, the wall thickness t(θ) is represented by t(θ)=R1−(2R1−Ga)·cos(θ)/2−(Db/2).

Therefore, the wall thickness at an angle of 0° from the groove bottom can be expressed as t(0°)=(Ga/2)−(Db/2), and the thickness at an angle of 45° as t (45°)=(Ga/2)−(Db/2)+$(2^{0.5}-1)\cdot(2R1-Ga)/(2\cdot 2^{0.5})$. Thus, geometrically, the steel tube produced will have a deviation in wall thickness of t(45°)−t(0°)=$(2^{0.5}-1)\cdot(2R1-Ga)/(2\cdot 2^{0.5})$.

According to the method proposed in the above-cited Japanese Patent Examined Publication No. H05-75485, the deviations in thickness are reduced by the geometrical calculation. In reality, however, greater deviations in thickness than the deviations given by calculations occur due to deviations in equipment installation and uneven wear of reduction rolls. In addition, the method proposed in the Japanese Patent Examined Publication No. H05-75485 has a problem in that the deviations in thickness occurring after setting of the mandrel mill has not been taken into consideration at all.

Accordingly, it is an object of the present invention, which has been completed in view of the above-mentioned prior art problems, to provide a method of producing seamless steel tubes by which not only the deviations in thickness occurring in the direction of reduction in the mandrel mill (see FIG. 8(*a*)) but also the deviations in thickness occurring in other directions than the direction of reduction (see FIG. 8(*b*)) can be suppressed.

SUMMARY OF THE INVENTION

The method of producing seamless steel tubes which comprises measuring the wall thicknesses within the circumferential directions of a seamless steel tube rolled in a production line comprising a mandrel mill, in which a plurality of reduction stands with reduction rolls are disposed in succession with the directions of reduction varied each other, and controlling separately and individually, based on the results of the measurement, the positions of both ends of each axis of the reduction rolls at least in the final reduction stands of the mandrel mill so that the deviations in wall thickness can be minimized.

By doing so, it becomes possible to effectively control the deviations in thickness at any position within the circumferential direction, irrespective of the direction of reduction.

BRIEF DESCRIPTION OF THE DRAWING

FIG. 2(*b*) is an illustration of No. 5 stand in the same mandrel mill, and FIG. 2(*c*) is an illustration of the channel directions of a hot wall thickness meter in the mandrel mill.

FIG. 7(*b*) is an illustration of a case of rolling in which deviations in thickness occur.

DESCRIPTION OF THE PREFERRED EMBODIMENTS

The method of producing seamless steel tubes which comprises measuring the wall thicknesses within the circumferential directions of a seamless steel tube rolled in a production line comprising a mandrel mill, in which a plurality of reduction stands with reduction rolls are disposed in succession with the directions of reduction varied each other, and controlling separately and individually, based on the results of the measurement, the positions of both ends of each axis of the reduction rolls at least in the final reduction stands of the mandrel mill so that the deviations in wall thickness can be minimized.

Thus, in accordance with the method of producing seamless steel tubes according to the invention, the wall thicknesses, at a plurality of positions within the circumferential directions, of a steel tube produced are measured, and positions of the both ends of each axis of the reduction rolls are controlled separately and individually in the manner of feedback at least in the final reduction stands of the mandrel mill to thereby make the thicker portions thinner and the thinner portions thicker, so that the deviation in thickness at any place within the circumferential direction can be controlled effectively, irrespective of the direction of reduction.

In carrying out the method of producing seamless steel tubes according to the invention, the measurements of the wall thicknesses within the circumferential direction of the produced steel tube may be carried out either on-line or off-line. However, on-line thickness measurements are of course desirable from the productivity viewpoint. In the case of off-line thickness measurements, the top of the tube, for instance, is marked during rolling and, after cutting, the thicknesses within the circumferential direction are measured referring to the marking.

To control separately and individually in carrying out the method of producing seamless steel tubes according to the invention includes not only the case in which all positions of the both ends of each axis of each roll of both upper and lower rolls are all controlled but also the case in which at least one position of at least one end or both ends of the axis of at least one roll of the reduction stand is controlled. It is a matter of course that the direction of controlling includes not only the case of controlling in opposite directions on both sides of the roll but also the case of controlling in the same direction.

EXAMPLES

In the following, the method of producing seamless steel tubes according to the invention is described referring to the examples shown in FIG. 1 and FIG. 2.

Figure 1:
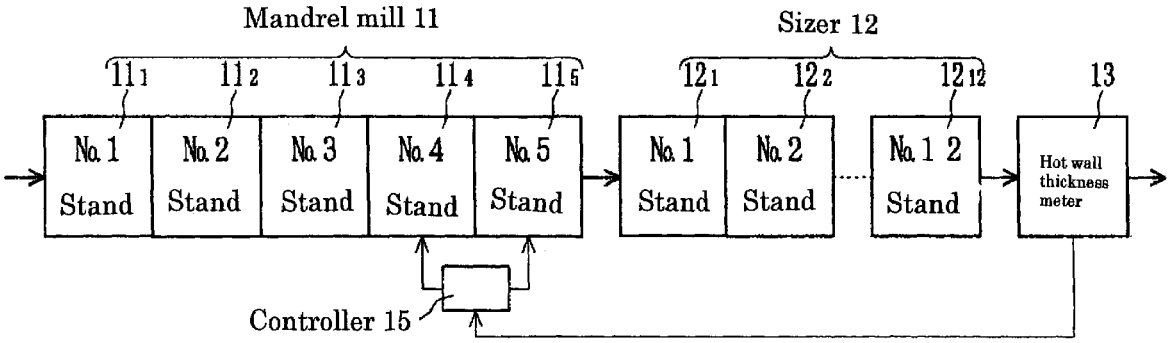
FIG. 1 is to illustrate the method of producing seamless steel tubes according to the invention, where the production line comprises a mandrel mill composed of a plurality of reduction stands with rolls disposed in succession.

FIG. 1 is a schematic illustration of a production line comprising a mandrel mill composed of a plurality of reduction stands each equipped with a pair of grooved rolls and disposed in succession. FIG. 2(*a*) is an illustration of No. 4 stand in the mandrel mill shown in FIG. 1, FIG. 2(*b*) is an illustration of No. 5 stand in the mandrel mill, and FIG. 2(*c*) is an illustration of the channel directions of a hot wall thickness meter in the mandrel mill.

Referring to FIG. 1, 11 is a mandrel mill in which No. 1 to No. 5 stands ($\mathbf{11}_1$ to $\mathbf{11}_5$) are disposed in succession with the directions of reduction in neighboring stands being varied by 90°, for instance, and 12 is a sizer comprising No. 1 to No. 12 stands ($\mathbf{12}_1$ to $\mathbf{12}_{12}$). On the outlet side of No. 12 stand ($\mathbf{12}_{12}$) of this sizer 12, there is disposed a hot wall thickness meter 13 having 8 measuring channel within the circumferential directions.

According to the invention, the wall thicknesses within the circumferential directions of the steel tube 14 produced by the above-mentioned mandrel mill 11 and sizer 12 are measured in the on-line manner by means of the hot wall thickness meter 13.

The thickness data obtained by the measurement are transmitted to a controller 15 and, in this controller 15, for example, the extents of groove closure of the both ends of the axis of the reduction rolls in the directions shown by boldface arrows in FIGS. 2(*a*) and 2(*b*) in the paired No. 4 stand ($\mathbf{11}_4$) and No. 5 stand ($\mathbf{11}_5$), which are finishing stands in the mandrel mill 11, are separately and individually computed in the manner described below based on the measured thicknesses. The No. 4 stand ($\mathbf{11}_4$) and No. 5 stand ($\mathbf{11}_5$) are thus controlled in the feedback manner.

In the following, an explanation is given about the extents of groove closure of the both ends of the axes of the reduction rolls in the No. 4 stand ($\mathbf{11}_4$) and No. 5 stand ($\mathbf{11}_5$) in the mandrel mill 11, which are to be computed in the controller 15.

Figure 2A:
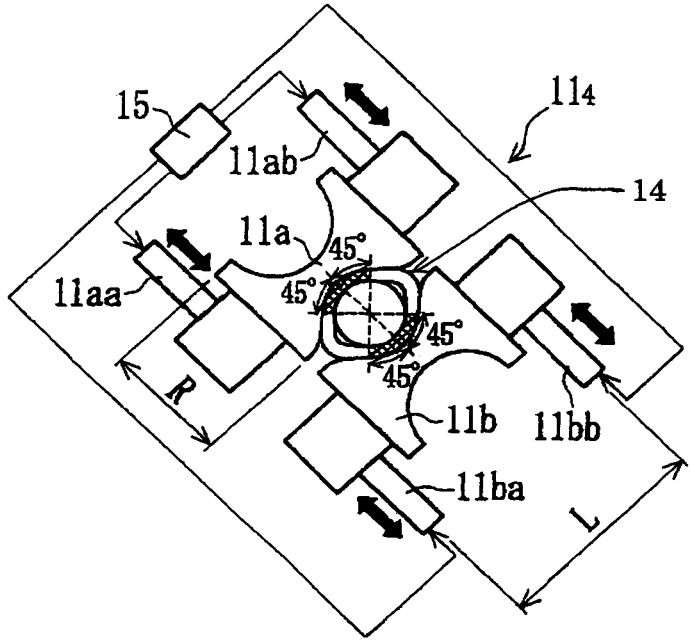
FIG. 2(*a*) is an illustration of No. 4 stand in the mandrel mill shown in FIG. 1.
Figure 2B:
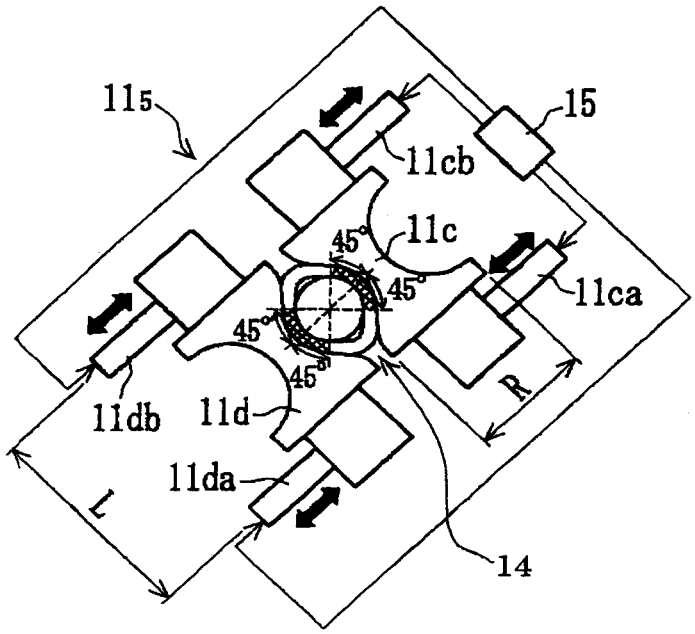
Figure 2C:
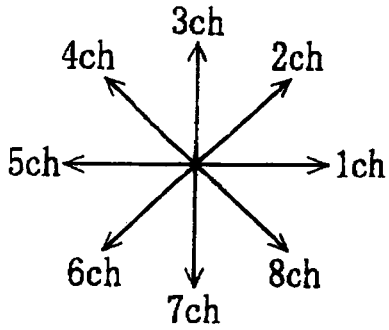

The extents of groove closure as caused by cylinders 11*aa* and 11*ab* disposed on both sides of an upper roll 11*a* constituting the reduction rolls in No. 4 stand ($\mathbf{11}_4$) are controlled by feeding back the results of the thickness measurements in the directions of channels 3, 4 and 5 among the channels 1 to 8 shown in FIG. 2(*c*) which are within the thickness reduction range of the above-mentioned upper roll 11*a*. The extents of groove closure as caused by cylinders 11*ba* and 11*bb* disposed on both sides of a lower roll 11*b* are controlled by feeding back the results of the thickness measurements in the directions of channels 1, 8 and 7 which are within the thickness reduction range of the above-mentioned lower roll 11*b*.

The extents of groove closure as caused by cylinders 11*ca* and 11*cb* disposed on both sides of an upper roll 11*c* constituting the passage in No. 5 stand ($\mathbf{11}_5$) are controlled by feeding back the results of the thickness measurements in the directions of channels 1, 2 and 3 which are within the thickness reduction range of the above-mentioned upper roll 11*c*. The extents of groove closure of both sides of a lower roll 11*d* are controlled by feeding back the results of the thickness measurements in the directions of channels 5, 6 and 7 which are within the thickness reduction range of the above-mentioned lower roll 11*d*.

In the controller 15, the extents of groove closure are determined in the following manner.

(1) Calculation of the extents of groove closure by the cylinders 11*ca* and 11*cb* disposed on both sides of the upper roll 11*c* in the No. 5 stand ($\mathbf{11}_5$)

When the data from wall thickness measurements for the 1 to 8 channel directions are represented by wt1 to wt8, respectively, the mean value $wt_{ave}$ of the thickness measurement data for these channels 1 to 8 can be represented as follows:

$$wt_{ave}=(wt1+wt2+\ldots+wt8)/8$$

Therefore, when the difference between the thickness measurement data wt2 for the channel 2 direction, which is found in the middle of the thickness reduction range of the upper roll 11*c*, and the mean value $wt_{ave}$, namely (wt2−$wt_{ave}$), is represented by dwt2, the difference between the thickness measurement data wt1 for the channel 1 direction and the thickness measurement data wt3 for the channel 3 direction (the channel 1 and 3 directions being found at both ends of the thickness reduction range of the upper roll 11*c*), namely (wt1−wt3), is represented by dwt13, the direction of opening of the cylinders 11*ca* and 11*cb* is represented by +, the direction of closure thereof by −, and the controlled variables for the cylinders 11*ca* and 11*cb* are represented by dca and dcb, respectively, then the following equations can be formulated:

$$dcb+dca=-2\times dwt2$$

$$dcb-dca=k\cdot dwt13$$

According to geometric calculations, k is equal to $2^{0.5}L/R$, where L is the cylinder distance and R is the roll radius (cf. FIG. 2(*b*)). In the case the deviations are not suppressed enough with the value of k calculated above in the specific mill conditions or reduction sizes, an empirical value of k may also be employed, however.

Therefore, development and arrangement of the above two equations give the following controlled variable dca for the cylinder 11*ca:*

$$dca=(-2\times dwt2-k\cdot dwt13)/2, \text{ and}$$

the following controlled variable dcb for the cylinder 11*cb:*

$$dcb=(-2\times dwt2+k\cdot dwt13)/2.$$

(2) Calculation of the extents of groove closure by the cylinders 11*da* and 11*db* disposed on both sides of the lower roll 11*d* in the No. 5 stand ($\mathbf{11}_5$)

When the difference between the thickness measurement data wt6 for the channel 6 direction, which is found in the middle of the thickness reduction range of the lower roll 11*d*, and the above-mentioned mean value $wt_{ave}$, namely (wt6−$wt_{ave}$), is represented by dwt6, and the difference between the thickness measurement data wt5 for the channel 5 direction and the thickness measurement data wt7 for the channel 7 direction (the channel 5 and 7 directions being found at both ends of the thickness reduction range of the lower roll 11*d*), namely (wt5−wt7), is represented by dwt57, then the controlled variables dda and ddb for the cylinders 11*da* and 11*db*, respectively, are calculated in the same manner as mentioned above, as follows:

$$dda=(-2\times dwt6+k\cdot dwt57)/2 \text{ and}$$

$$ddb=(-2\times dwt6-k\cdot dwt57)/2.$$

(3) Calculation of the extents of groove closure by the cylinders 11*aa* and 11*ab* disposed on both sides of the upper roll 11*a* in the No. 4 stand ($\mathbf{11}_4$)

When the difference between the thickness measurement data wt4 for the channel 4 direction, which is found in the middle of the thickness reduction range of the upper roll 11*a*, and the above-mentioned mean value $wt_{ave}$, namely (wt4−$wt_{ave}$), is represented by dwt4, and the difference between the thickness measurement data wt3 for the channel 3 direction and the thickness measurement data wt5 for the channel 5 direction (the channel 3 and 5 directions being found at both ends of the thickness reduction range of the upper roll 11*a*), namely (wt3−wt5), is represented by dwt35, then the controlled variables daa and dab for the cylinders 11*aa* and 11*ab*, respectively, are calculated in the same manner as mentioned above, as follows:

$$daa=(-2\times dwt4+k\cdot dwt35)/2 \text{ and}$$

$$dab=(-2\times dwt4-k\cdot dwt35)/2.$$

(4) Calculation of the extents of groove closure by the cylinders 11*ba* and 11*bb* disposed on both sides of the lower roll 11*b* in the No. 4 stand ($\mathbf{11}_4$)

When the difference between the thickness measurement data wt8 for the channel 8 direction, which is found in the middle of the thickness reduction range of the lower roll 11*b*, and the above-mentioned mean value $wt_{ave}$, namely (wt8−$wt_{ave}$), is represented by dwt8, and the difference between the thickness measurement data wt7 for the channel 7 direction and the thickness measurement data wt1 for the channel 1 direction (the channel 7 and 1 directions being found at both ends of the thickness reduction range of the lower roll 11*b*), namely (wt7−wt1), is represented by dwt71, then the controlled variables dba and dbb for the cylinders 11*ba* and 11*bb*, respectively, are calculated in the same manner as mentioned above, as follows:

$$dba=(-2\times dwt8-k\cdot dwt71)/2 \text{ and}$$

$$dbb=(-2\times dwt8+k\cdot dwt71)/2.$$

In this connection, a raw tube having an outside diameter of 435 mm and a wall thickness of 19.0 mm was subjected to rolling for stretching and wall thickness reduction in a 5-stand mandrel mill having the constitution shown in FIG. 1 to an outside diameter of 382 mm and a wall thickness of 9.0 mm, followed by sizing to an outside diameter of 323.9 mm and a wall thickness of 9.5 mm in a 12-stand sizer. Typical examples of the results of measurements by means of a hot wall thickness meter (mean values in the lengthwise direction of the steel tube) as obtained in this case by carrying out the method of the invention and without carrying out the same are shown below in Table 1, and in FIG. 3. In Table 2 given below, there are shown the controlled variable values applied to the cylinders of No. 4 and No. 5 stands in the mandrel mill for obtaining the results shown in Table 1.

TABLE 1

| | Channel 1 | Channel 2 | Channel 3 | Channel 4 | Channel 5 | Channel 6 | Channel 7 | Channel 8 |
|---|---|---|---|---|---|---|---|---|
| Invention not practiced | 10.21 | 9.43 | 8.75 | 9.35 | 10.16 | 9.53 | 8.82 | 9.79 |
| Invention practiced | 9.89 | 9.70 | 9.62 | 9.43 | 9.36 | 9.50 | 9.40 | 9.42 |
| | | | | | | | | (in mm) |

TABLE 2

| | | | |
|---|---|---|---|
| No. 4 stand | Upper roll | 11aa | +0.69 |
| | | 11ab | −1.26 |
| | Lower roll | 11ba | −0.84 |
| | | 11bb | +1.15 |
| No. 5 stand | Upper roll | 11ca | +0.92 |
| | | 11cb | −0.97 |
| | Lower roll | 11da | −0.95 |
| | | 11db | +1.10 |
| | | | (in mm) |

Figure 3A:
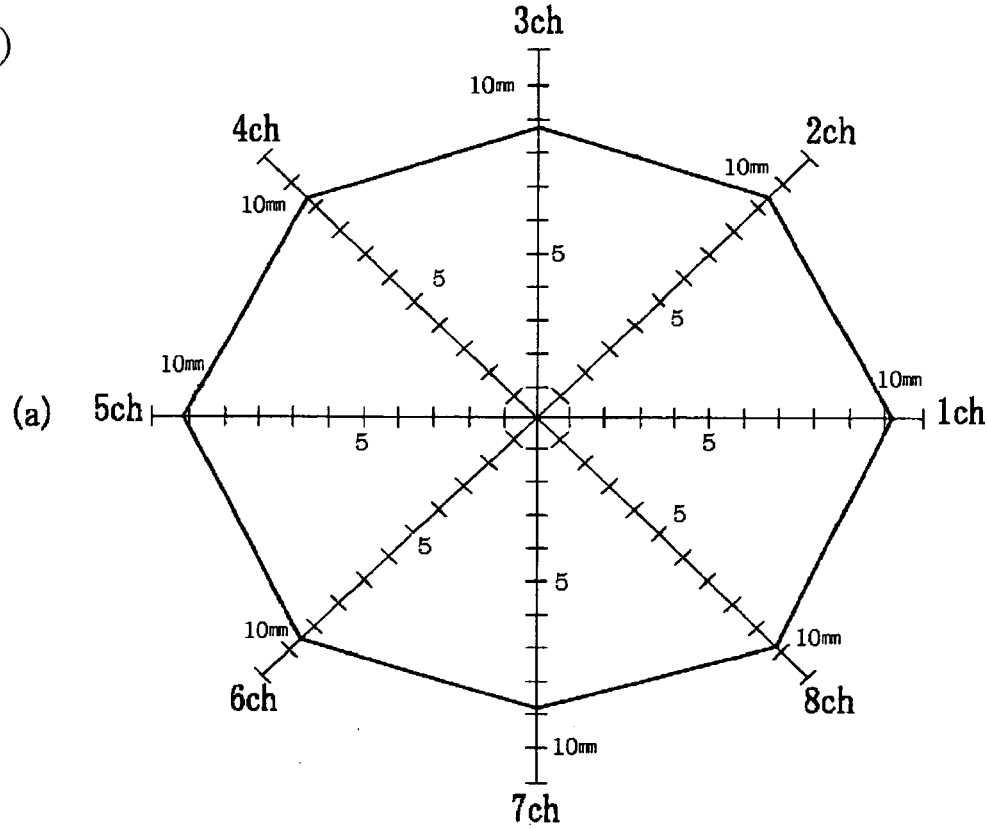
FIG. 3 shows typical examples of the results of measurement by means of the hot wall thickness meter. Thus, FIG. 3(*a*) is a representation of such results in an example in which the method of the invention was not carried out, and FIG. 3(*b*) is a representation of the results in an example in which the method of the invention was carried out.
Figure 3B:
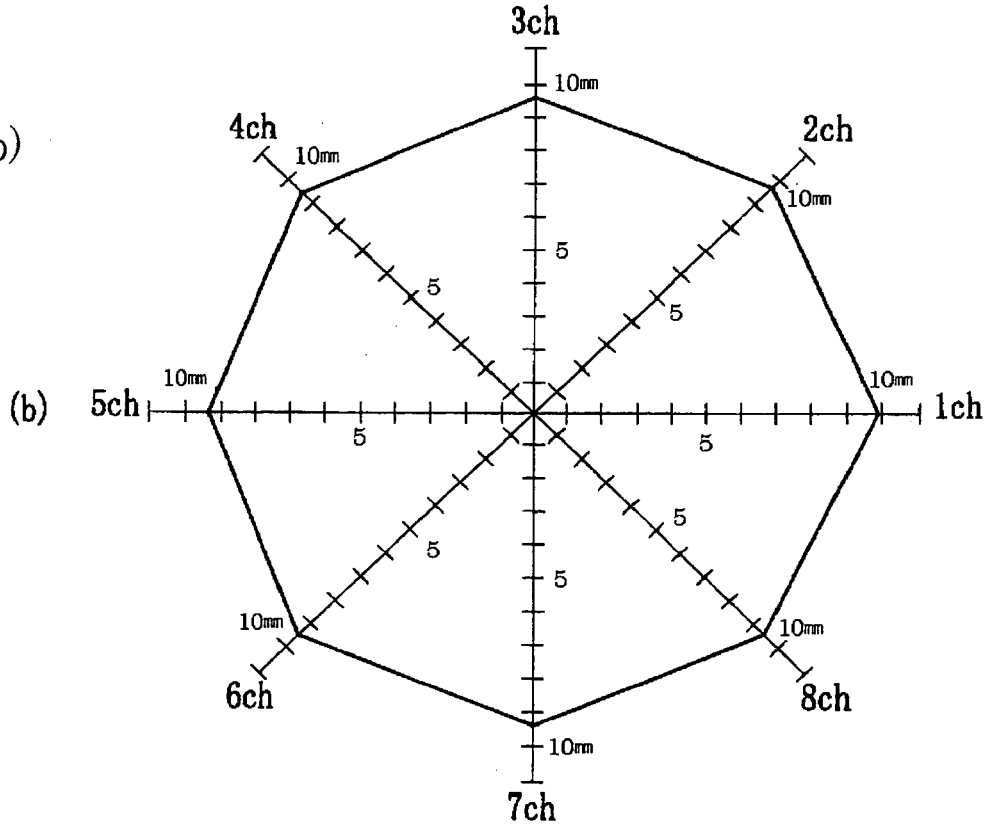

As is evident from the above Table 1 and from FIG. 3, the employment of the method of the invention reduced the deviation in wall thickness from 1.46 mm (maximum wall thickness (10.21 mm)−minimum wall thickness (8.75 mm)=1.46 mm) before practicing the method of the invention to 0.53 mm (9.89 mm−9.36 mm=0.53 mm).

Figure 4:
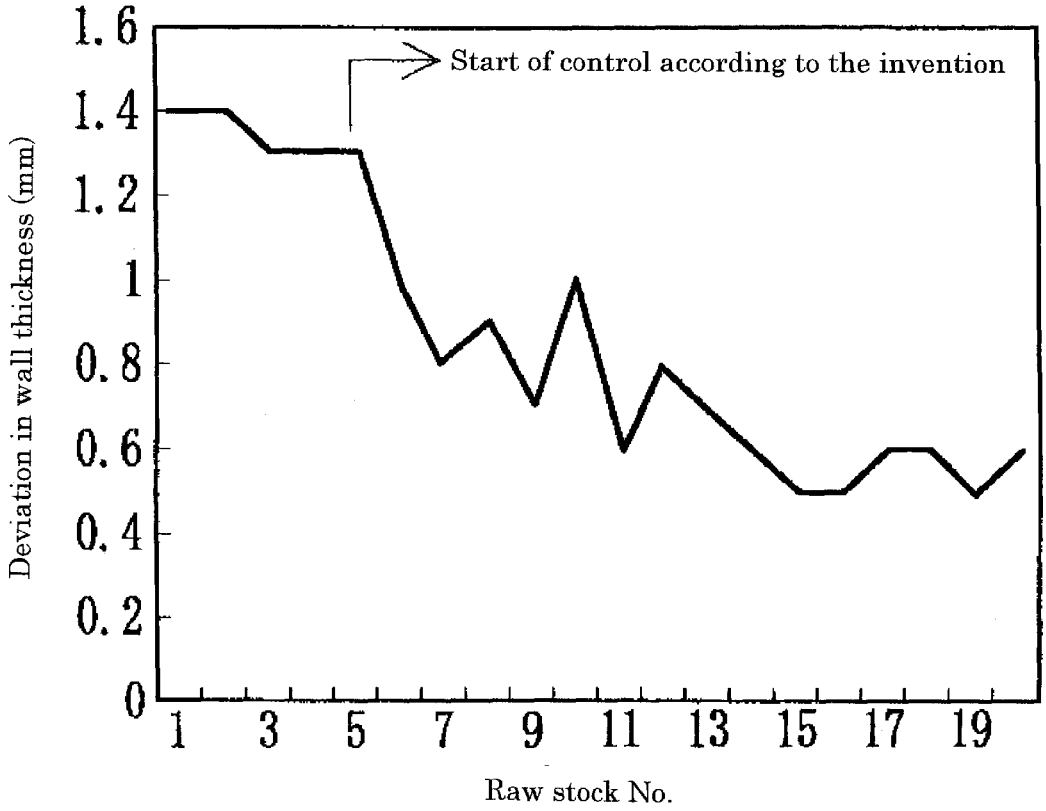
FIG. 4 is a graphic representation of the changes in deviation in thickness by starting of cylinder control according to the invention.
Figure 5:
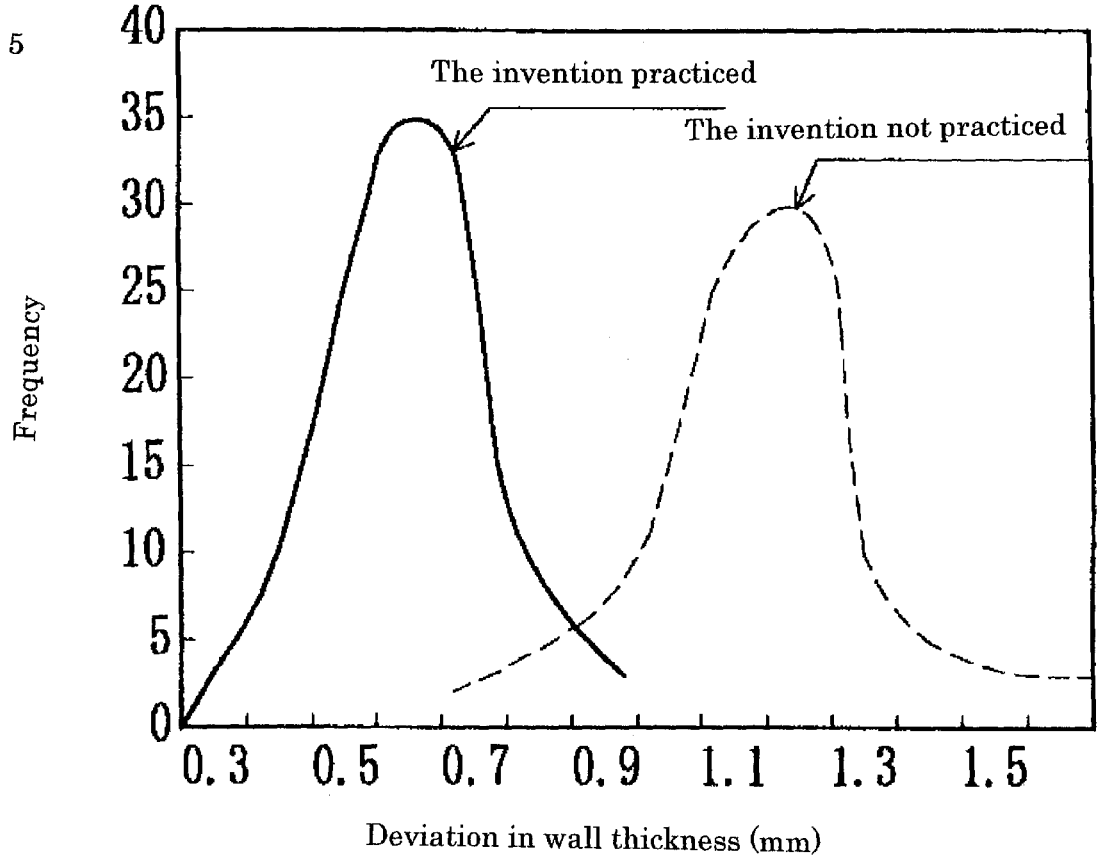
FIG. 5 is a graphic representation of the distribution of the deviations in thickness before and after the start of cylinder control according to the invention.
Figure 6:
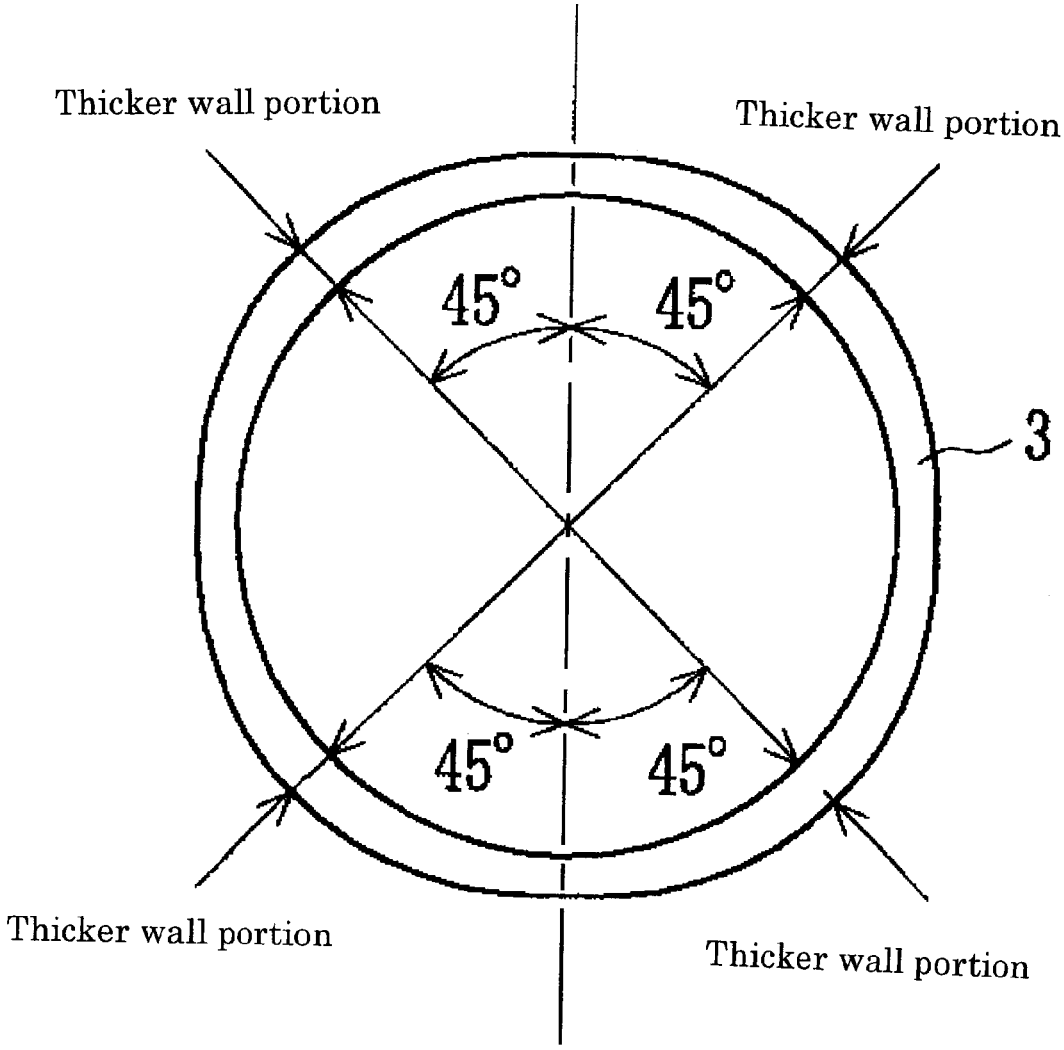
FIG. 6 is an illustration of the wall thickness distribution in a seamless steel tube produced in a mandrel mill in which the directions of reduction of neighboring 2-roll stands cross at 90° each other.
Figure 7A:
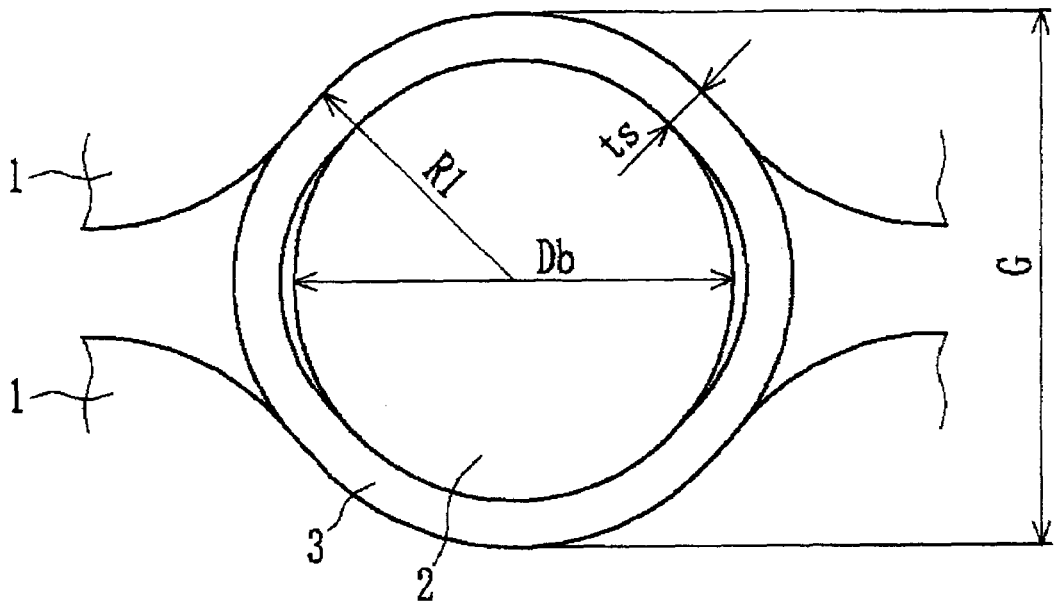
FIG. 7 illustrates the states of rolling using a mandrel mill in which the directions of reduction of neighboring 2-roll stands cross at 90° each other. Thus, FIG. 7(*a*) is an illustration of an ideal case of rolling in which there is no deviation in thickness.
Figure 7B:
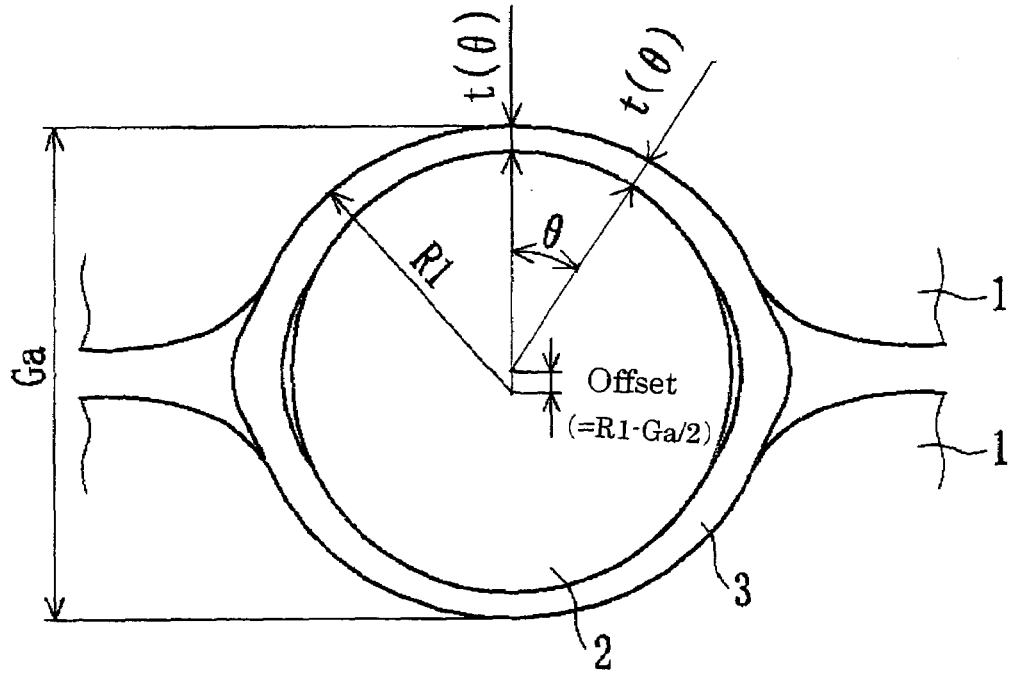
Figure 8A:
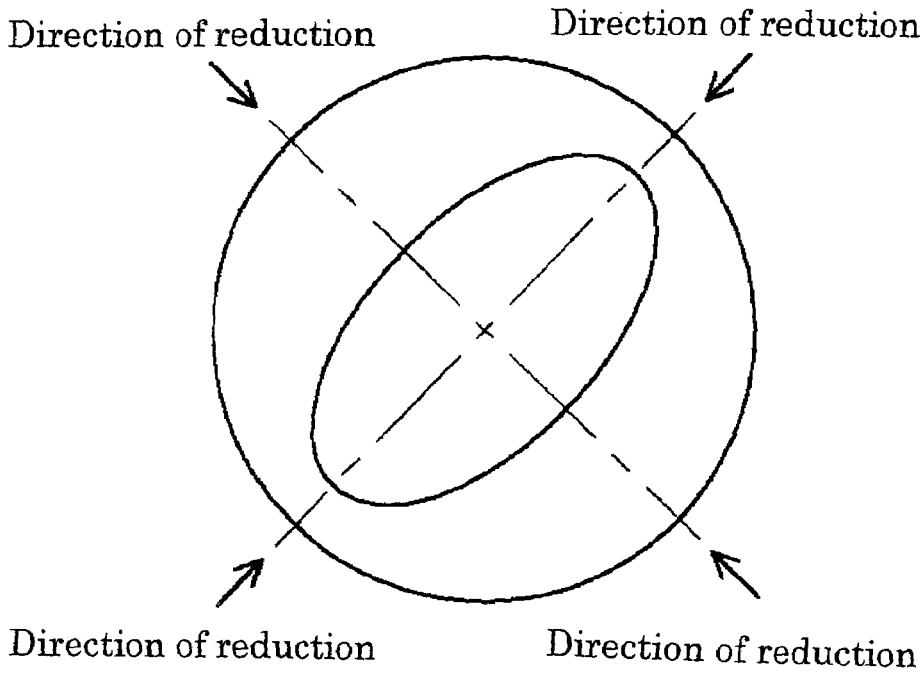
FIG. 8(*a*) is an illustration of the occurrence of deviations in thickness in the direction of reduction in a mandrel mill, and FIG. 8(*b*) is an illustration of a case where deviations in thickness occur at places deviating from the direction of reduction.
Figure 8B:
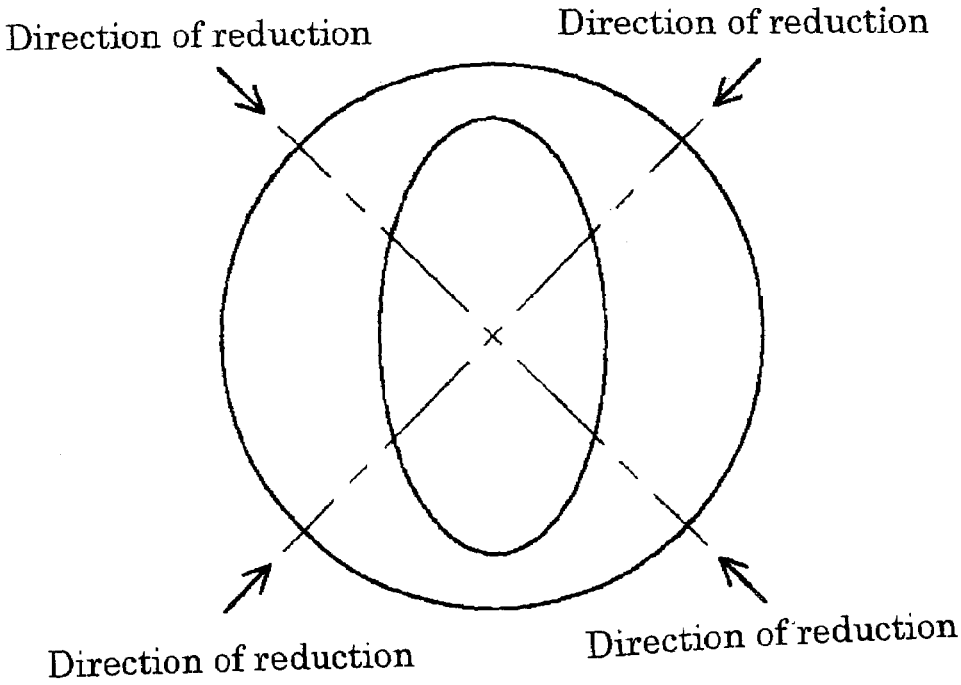

Further, FIG. 4 shows the changes in deviation in thickness before and after the start of cylinder control according to the invention, in No. 4 and No. 5 stands of the mandrel mill in the above example, and FIG. 5 shows the distribution of the deviations in thickness before and after the start of the same cylinder control according to the invention. It is evident that the deviations in wall thickness can be effectively suppressed by practicing the method of the invention.

Although, in this example, only the extents of groove closure on both sides of each axis of the reduction rolls of the final two reduction stands in the mandrel mill were controlled, it is also possible to control the extents of groove closure on both sides of each axis of the reduction rolls of another or other stands constituting the mandrel mill. On that occasion, feedback control may also be made by distributing the amount of reduction, for example 80% of reduction is done in the final two paired reduction stands and 20% of reduction is done in another or other stands. While the wall thickness measurements were carried out on-line in this example, it is also possible to use the results of off-line measurements for feedback.

INDUSTRIAL APPLICABILITY

The invention makes it possible to effectively suppress or control not only the deviations in wall thickness occurring in the direction of reduction in a mandrel mill but also the derivations in thickness occurring at places deviating from the above-mentioned direction of reduction by measuring the wall thicknesses of a steel tube under manufacture, and controlling, by feedback, the extents of groove closure on both sides of each axis at least in the last two paired reduction stands separately and individually; thus, the ratio of accepted products in wall thickness inspection can be increased, and the yield of thin-walled products within the specified tolerance range can be improved.

What is claimed is:

1. A method of producing seamless steel tubes which comprises:

rolling a seamless steel tube in a production line comprising a mandrel mill, in which a plurality of reduction stands with reduction rolls are disposed in succession with the directions of reduction varying with respect to each other, measuring respectively the wall thicknesses within the circumferential directions of the seamless steel tube produced, not only at the direction of reduction but also at directions corresponding to both sides of each axis of the reduction rolls, and controlling separately and individually based on the results of the measurement of the respective wall thicknesses, the positions of both ends of each axis of the reduction rolls in at least a final pair of reduction stands of the mandrel mill so that the deviations in wall thickness can be minimized.

* * * * *